US006461174B1

(12) United States Patent
Hwang

(10) Patent No.: US 6,461,174 B1
(45) Date of Patent: Oct. 8, 2002

(54) POWER CONNECTOR MORE EASILY AND CHEAPLY MANUFACTURED

(75) Inventor: Jenq-Yih Hwang, Irvine, CA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 09/954,143

(22) Filed: Sep. 12, 2001

(51) Int. Cl.[7] ..... H01R 12/00
(52) U.S. Cl. ..... 439/80; 439/78
(58) Field of Search ..... 439/78–80

(56) References Cited

U.S. PATENT DOCUMENTS 3,697,933 A * 10/1972 Black et al. ..... 439/80
4,191,440 A * 3/1980 Schramm ..... 439/78
4,749,357 A * 6/1988 Foley ..... 439/80
4,824,380 A * 4/1989 Matthews ..... 439/78
4,946,392 A * 8/1990 Kobler et al. ..... 439/78
4,983,127 A * 1/1991 Kawai et al. ..... 439/79
5,055,055 A * 10/1991 Bakker ..... 439/78
5,376,012 A * 12/1994 Clark ..... 439/80
5,807,120 A * 9/1998 Matthews ..... 439/80

* cited by examiner

*Primary Examiner*—Gary F. Paumen
(74) *Attorney, Agent, or Firm*—Wei Te Chung

(57) ABSTRACT

A power connector includes a dielectric housing (20), a metal pin (30), a number of terminal plates (50), and a dielectric bottom cover (40). The housing includes two side walls (23) which each define a number of slots (230). The terminal plates each have a square plate (51) and a pair of contacts (52) extending from a lower edge of the square plate. A six-sided center aperture (510) and three surrounding rim apertures (512) are defined in the square plate. The terminal plates are assembled into the slots of the housing and the bottom cover is assembled into the bottom of the housing. The pattern of the center and three side apertures allows sides of the center aperture (510) to resiliently distort outwardly, allowing the metal pin to be inserted therethrough.

1 Claim, 9 Drawing Sheets

POWER CONNECTOR MORE EASILY AND CHEAPLY MANUFACTURED

BACKGROUND OF THE INVENTION

1. Field of the Invention

The present invention relates to an electrical connector, and particularly to a power connector which can be easily and cheaply manufactured.

2. Brief Description of the Prior Art

Referring to FIG. 9, U.S. Pat. No. 5,055,055 discloses a conventional power connector 700 for connecting two printed circuit boards together. The power connector 700 comprises a conductive connector body 717, a dielectric shell 715 surrounding the connector body 717, a plurality of contacts 714, a crown band electrical contact 716, and a metallic pin 718 retained in the connector body 717. A socket 722 longitudinally extends through the connector body 717 for receiving the crown band 716 and the pin 718.

The connector body 717 is die-cast and is thus expensive to manufacture. In assembly, the crown band 716 is first fit into the socket 722 and the pin 718 is then slideably inserted into the socket, so that the pin 718 resiliently engages with the crown band 716. The crown band 716 is delicate and the crown band to pin 718 interface is not robust. The dielectric shell 715 adds further fabrication cost and another step in connector assembly. Manufacture of the power connector 700, therefore, is relatively complicated and expensive.

Referring to FIGS. 10 and 11, U.S. Pat. No. 5,807,120 discloses a male electrical connector 800 for making a power connection between adjacent boards. An insulative housing 814 has openings 858, 859 at each end thereof with a cavity between the openings. An arched conductive body 817 has latching elements 826, which, along with an insulative alignment member 818, retain the body 817 in the housing 814. An electrical contact band 816 fits within body 817, and contact pin 848 slides into floating contact with the band 816. The contact pin 848 is held within the housing 814 by locking portion 866 and beveled surface 868 sandwiching a lip (not labeled) of the opening 858 therebetween. By its design, the pin 848 can move relative to the housing 814 to allow connection between slightly misaligned boards. However, in this design, the band 816 is very delicate and assembly of the connector is relatively complicated.

The present invention improves upon the prior art by providing a very simple connector design having cheaply fabricated parts which are easily assembled. The result is a robust connector which has a pin having the freedom of movement necessary to provide a high capacity power connection between two slightly misaligned boards.

BRIEF SUMMARY OF THE INVENTION

A first object of the present invention is to provide an inexpensive power connector which can provide a high current power connection between two printed circuit boards;

A second object of the present invention is to provide an easily assembled power connector.

To achieve the above-mentioned objects, a power connector in accordance with the present invention includes an insulative housing, a metal pin, five terminal plates received in the housing, and an insulative bottom cover attached to the housing.

The housing has a front wall defining an opening, and a rear wall opposite the front wall, lateral sidewalls and a top wall. A cavity is defined between the front wall, rear wall, sidewalls, and top wall. Each sidewall defines a plurality of slots communicating with the cavity.

Each terminal plate includes a square-shaped plate with a pair of integral contacts depending from a lower edge of the plate. A center aperture and three rim apertures disposed around the center aperture are punched through the plate.

The metal pin is cylindrically shaped and has a rounded front end and a tapered rear end.

The bottom cover is rectangular shaped and defines a plurality of slits spaced along its lateral sides. A semi-circular trough is formed in a top side of the bottom cover.

Side edges of the terminal plates are secured in the housing with the contacts protruding from a bottom of the housing. The bottom cover is pushed upward into the housing where it is snappingly secured by a wedge and notch arrangement. The metal pin is pressed rear end first through the opening in the front wall of the housing, and sequentially through each center aperture of each terminal plate. The arrangement of the center aperture and the rim apertures provides a resilient engagement between the metal pin and the terminal plates.

Other objects, advantages and novel features of the present invention will become more apparent from the following detailed description of the present embodiment when taken in conjunction with the accompanying drawings.

DETAILED DESCRIPTION OF THE INVENTION

Figure 1:
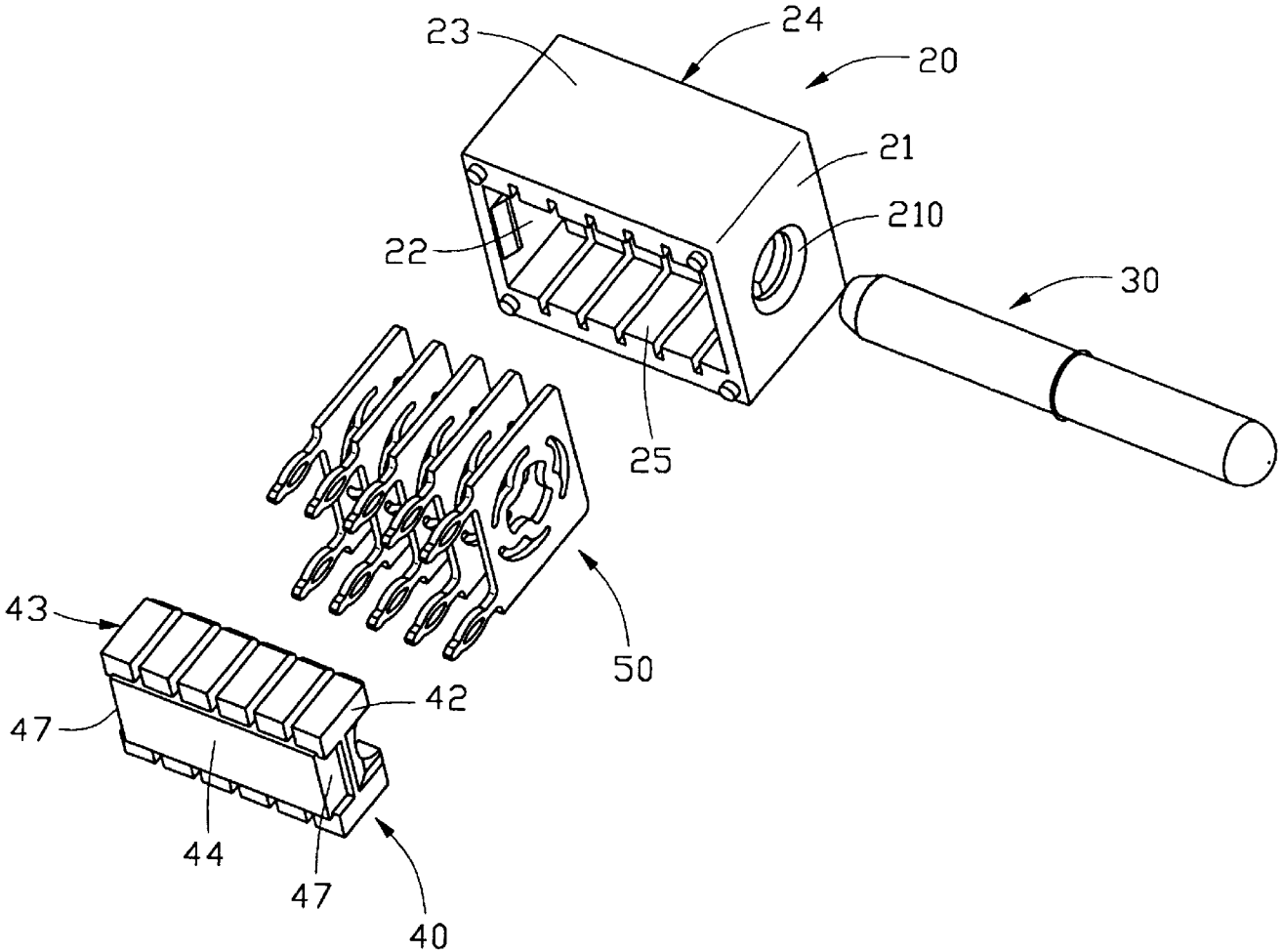
FIG. 1 is an exploded view of a power connector in accordance with the present invention.

Referring to FIG. 1, a plug type power connector 1 of the present invention comprises a dielectric housing 20, a conductive, metal pin 30, a dielectric bottom cover 40, and a plurality of terminal plates 50.

Figure 2:
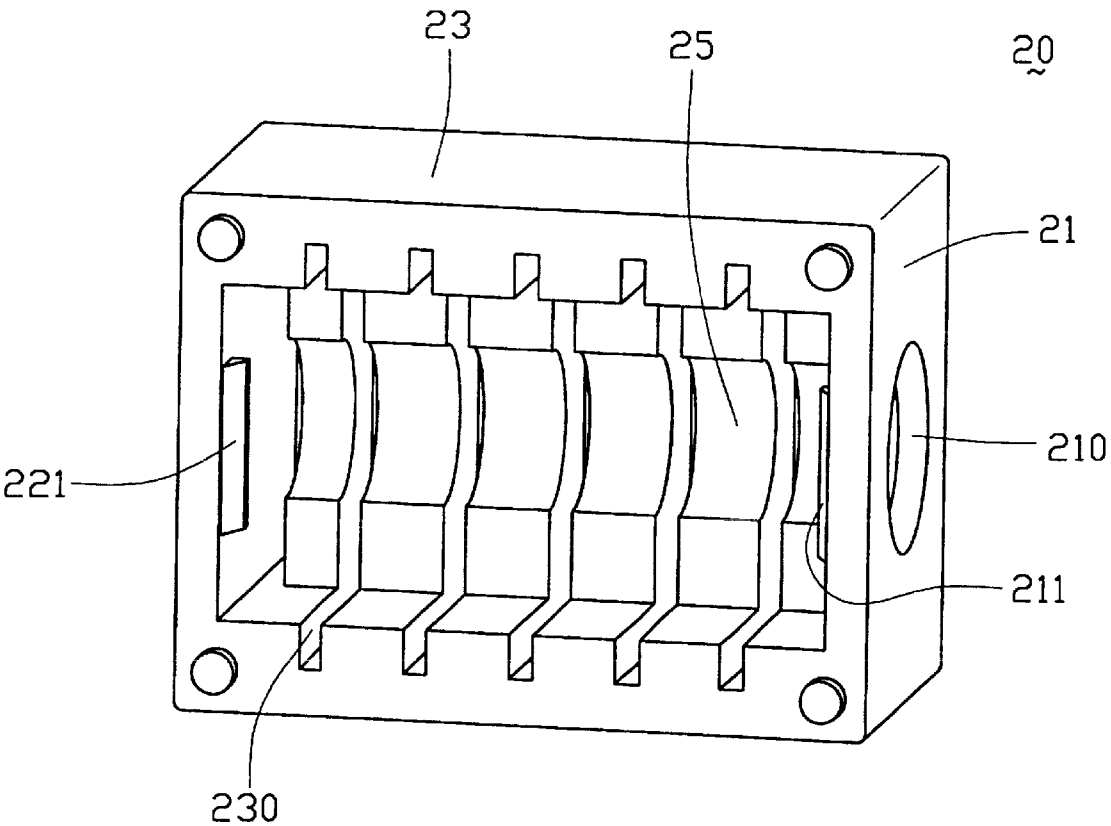
FIG. 2 is a perspective view of a housing of the power connector of FIG. 1 from a bottom aspect.

As shown in FIG. 2, the housing 20 is in the shape of a box and includes a front wall 21, a rear wall 22 opposite the front wall 21, a pair of sidewalls 23, and a top wall 24. A cavity 25 is defined between the front wall 21, the rear wall 22, the sidewalls 23, and the top wall 24. The front wall 21 defines an opening 210 in communication with the cavity 25. Each sidewall 23 defines a plurality of vertical slots 230 in an inner surface thereof, the vertical slots 230 each being in communication with the cavity 25. A pair of wedges 221 is formed in the housing, one on an inside surface of the rear wall 22 and one on an inside surface of the front wall 21.

Figure 3:
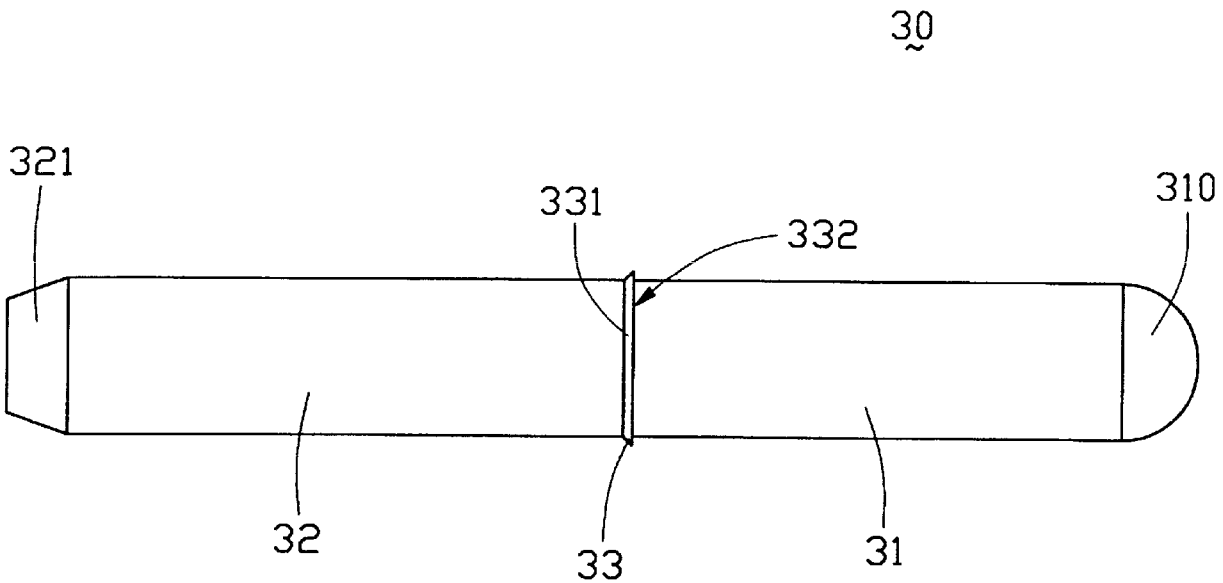
FIG. 3 is a side view of a metal pin of the power connector of FIG. 1.

The metal pin 30 (FIG. 3) is cylindrical in shape and includes a front section 31 and a rear section 32. An annular ring 33 is formed at the boundary between the front section 31 and the rear section 32. The annular ring 33 has an inclined rear surface 331 adjacent the rear section 32 and a front surface 332, which is perpendicular to the cylindrical surface of the front section 31. A diameter of the rear section 32 is slightly smaller than an inside diameter of the opening 210 of the housing 20, and a largest diameter of the ring 33 is slightly larger than the inside diameter of the opening 210. The front section 31 has a rounded front end 310 and the rear section 32 has a tapered rear end 321.

Figure 4:
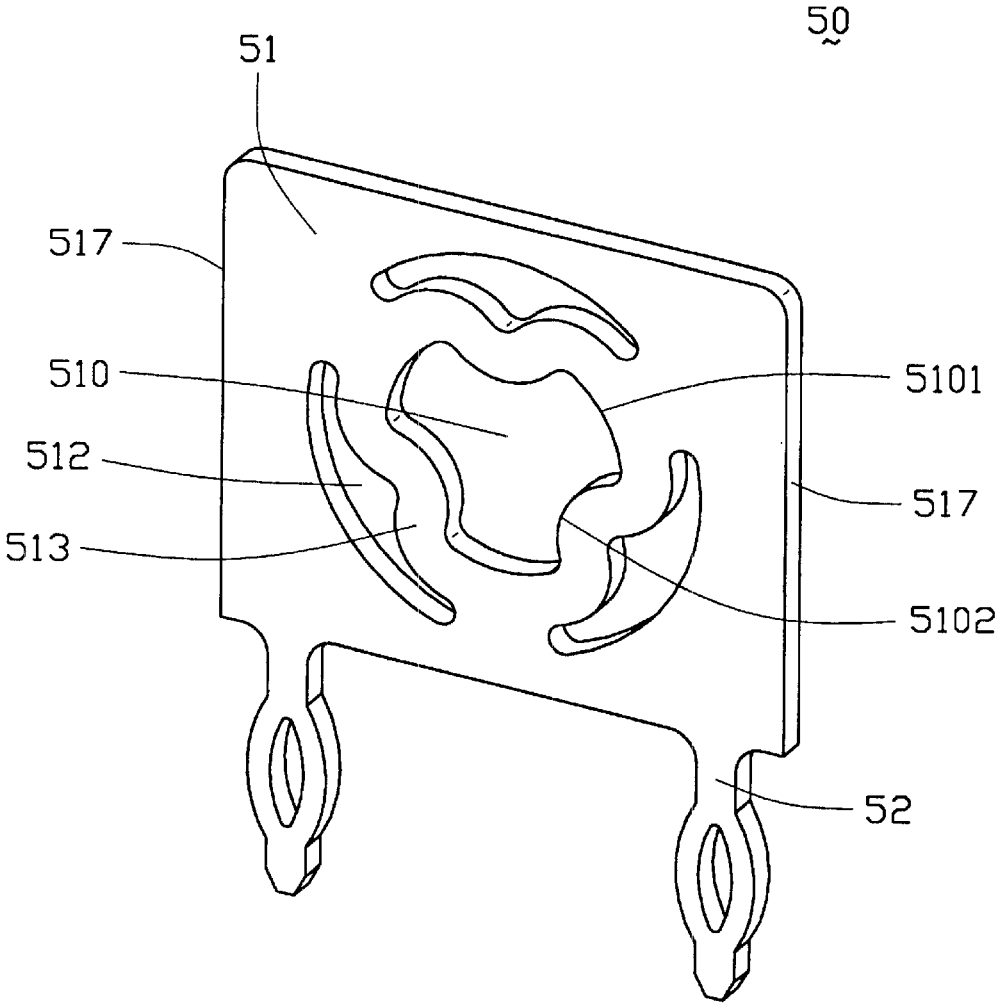
FIG. 4 is a perspective view of a terminal plate of the power connector of FIG. 1.

Each terminal plate 50 (FIG. 4) comprises an approximately square-shaped plate 51 and two contacts 52 depending from a lower edge of the plate 51. A side edge 517 is located at each of opposite sides of the plate 51. A six-sided center aperture 510 is defined through a middle of the plate 51. Three convexly curved sides 5101 of the center aperture 510 alternate with three concavely curved sides 5102. Three crescent-shaped rim apertures 512 are symmetrically defined around the center aperture 510, each rim aperture 512 being located opposite a corresponding one concavely curved side 5102. A resilient arm 513 is formed between each concavely curved side 5102 and each rim aperture 512. Each contact 52 has a collapsible needle eye to help in attaching the terminal plate 50 to a pair of through holes defined in a printed circuit board (not shown).

Figure 5:
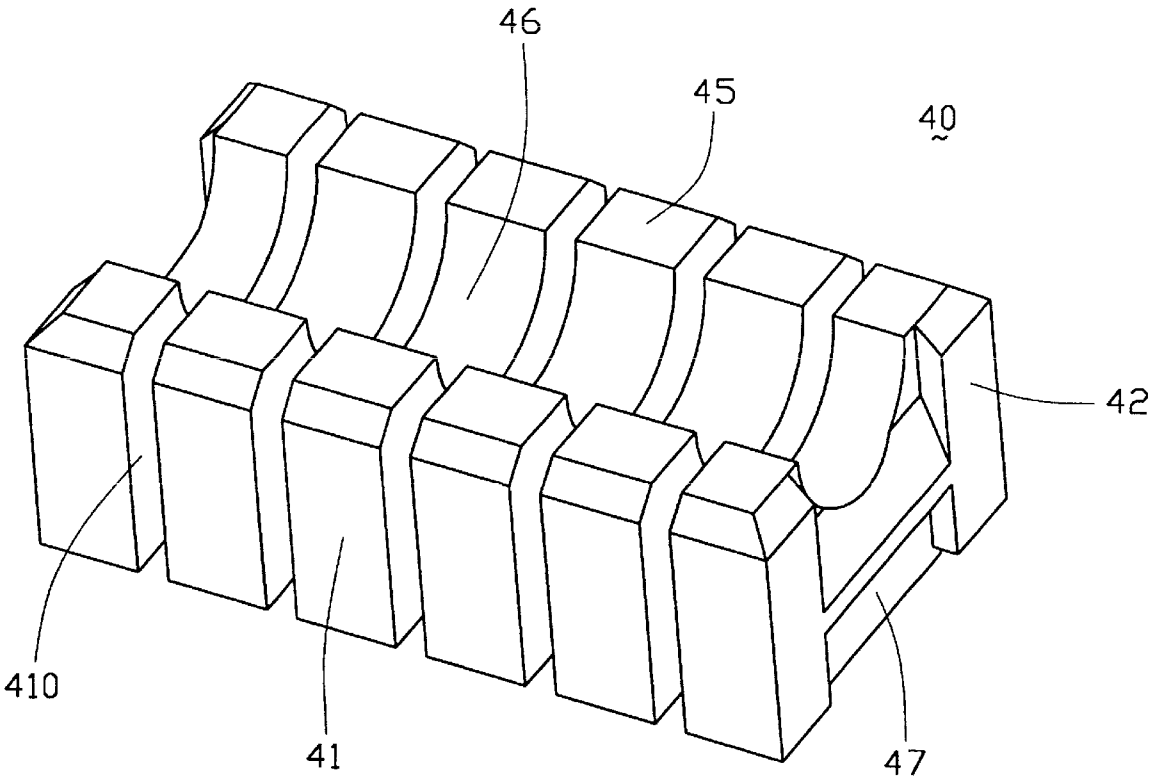
FIG. 5 is a perspective view of a bottom cover of the power connector of FIG. 1.

Referring to FIG. 5, the dielectric bottom cover 40 has a rectangular box shape, with a pair of opposite lateral sides 41, a front side 42, a rear side 43 a bottom side 44 and a top side 45. A plurality of slits 410 are defined in each lateral side 41, corresponding in spacing and placement to the slots 230 of the housing 20. A trough 46 is defined in the top side 45 corresponding in shape to the cylindrical surface of the rear section 32 of the metal pin 30. A rectangular shaped notch 47 is defined in a lower edge of the front side 42 and in a lower edge of the rear side 43.

Figure 6:
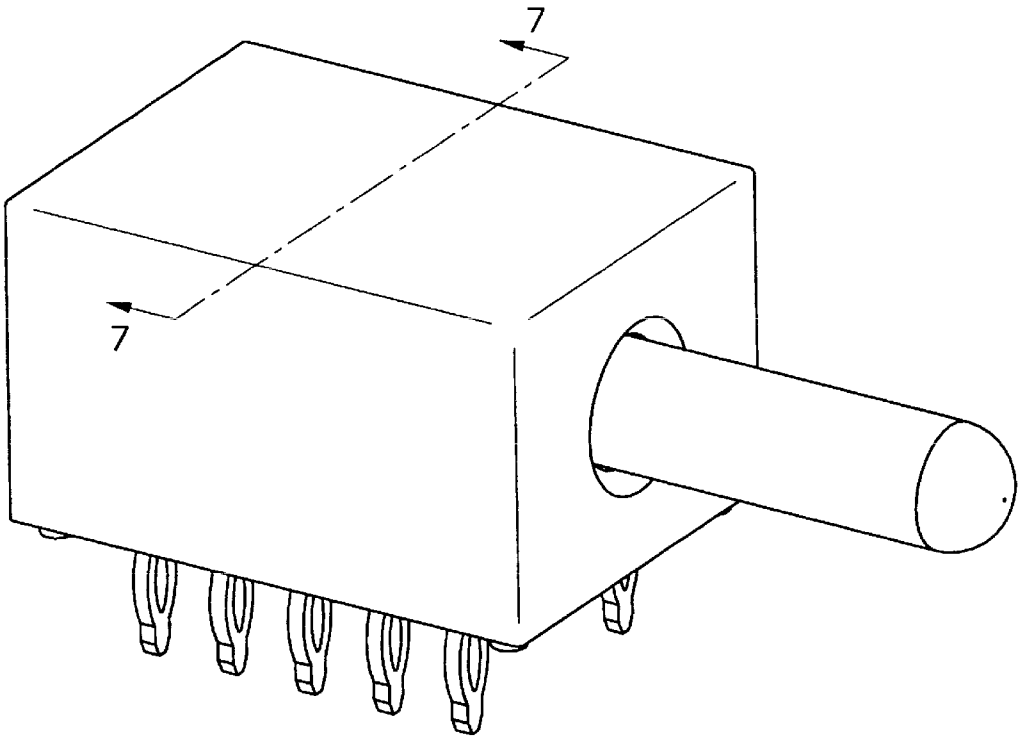
FIG. 6 is an assembled view of the power connector of FIG. 1.
Figure 7:
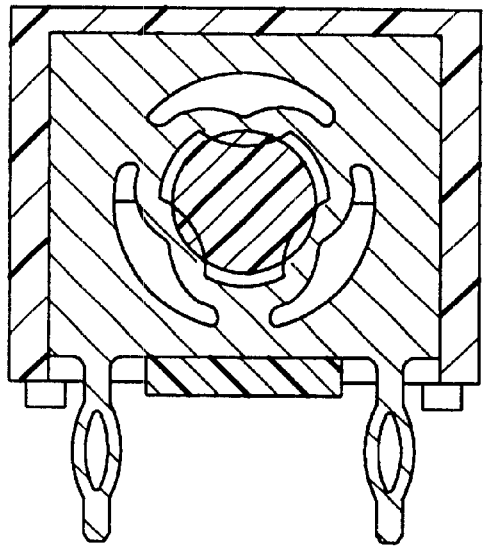
FIG. 7 is a cross-sectional view of the power connector taken along the line 7—7 of FIG. 6, but showing the terminal plate in a not-flexed state for illustration.
Figure 8:
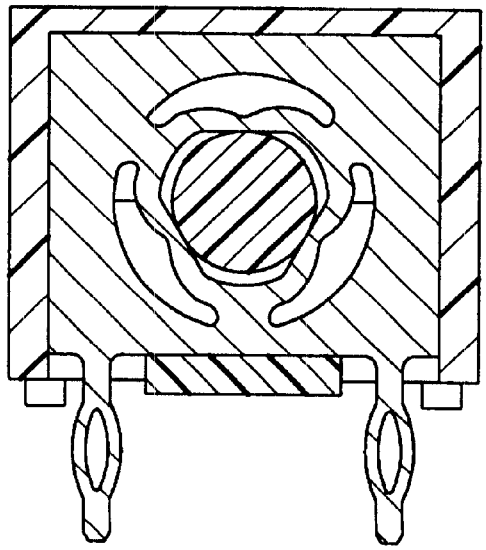
FIG. 8 is a cross-sectional view of the power connector taken along the line 7—7 of FIG. 6, but showing the terminal plate in a realistic, flexed state.
Figure 9:
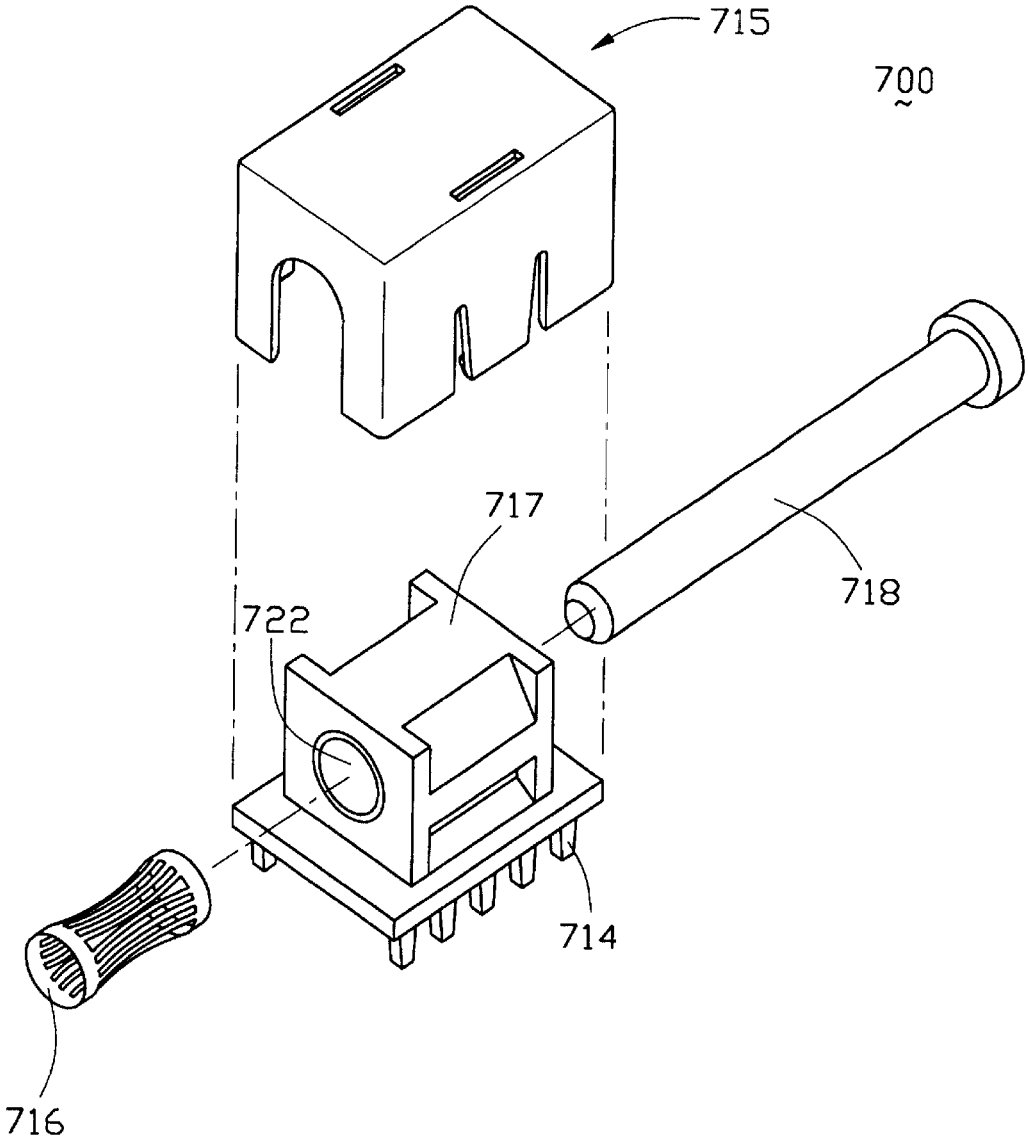
FIG. 9 (PRIOR ART)
FIG. 9 is an exploded view of a first conventional power connector.
Figure 10:
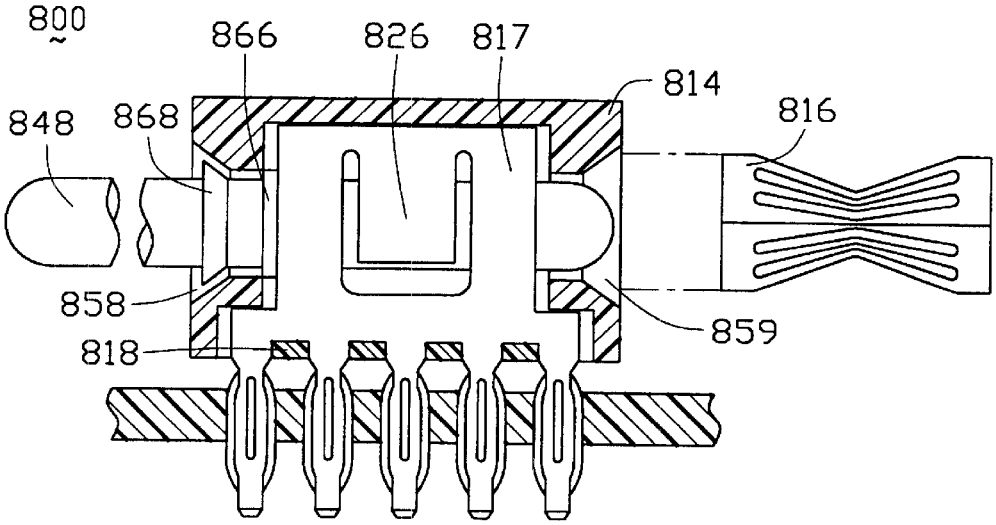
FIG. 10 (PRIOR ART)
FIG. 10 is a side view of a conductive body and a contact band of a second conventional power connector.
Figure 11:
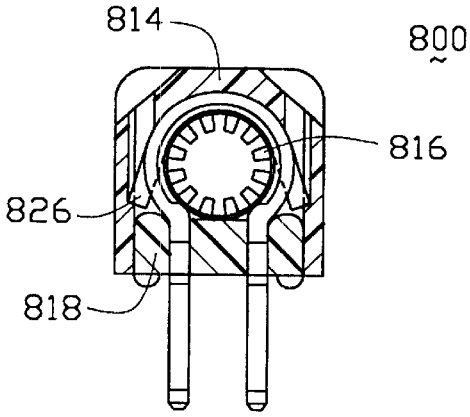
FIG. 11 (PRIOR ART)
FIG. 11 is a front, partially cut away view of the second conventional power connector.

In assembly, referring to FIGS. 6–8, each terminal plate 50 is inserted upward into the cavity 25 of the housing 20, each side edge 517 sliding into a corresponding slot 230 of a corresponding sidewall 23 of the housing 20. The bottom cover 40 is inserted upward into the cavity 25, each contact 52 of the terminal plates 50 fitting into a corresponding slit 410 of the bottom cover 40. The bottom cover 40 is pressed upwardly into the cavity until the wedges 211, 221 of the housing lock in the notches 47 of the bottom cover 40. The rear section 32 of the metal pin 30 is inserted, rear end 321 first, through the opening 210 in the front wall 21 of the housing. The metal pin 30 is inserted through the cavity 25, sequentially through the center aperture 510 of each terminal plate 50, until the ring 33 snuggly pushes through the opening 210 of the front wall 21 of the housing 20, locking against the inside surface of the front wall 21. The inclination of the rear surface 331 of the ring 33 helps the ring to fit through the opening 210, and the perpendicular front surface 332 of the ring 33 locks the metal pin 30 in the housing 20. The tapering of the rear end 321 of the metal pin 30 helps it start penetration of each center aperture 510, and, as the metal pin 30 slides rearwardly, the three arms 513 of each terminal plate 50 resiliently flex outwardly, pressing inwardly against the sides of the metal pin 30. (Note that FIG.7 shows the arms 513 in their unflexed state to illustrate the amount of flexion required in each arm 513 to fit the metal pin 30 through the center aperture 510. FIG. 8 shows a more realistic view with the arms 513 resiliently flexing.) The alloy of the terminal plate 50 and dimensions of the arms 513 are such that the arms 513 retain their resiliency after fully bending, and also exert an inward force which securely presses inwardly against the metal pin 30.

Because of the design of the terminal plates 50, the metal pin 30 can be said to "float" within the center apertures 510 of the terminal plates 50. It is a feature of the present invention that, if the need arises, the pin can move laterally in the center apertures 510 of the terminal plates 50. Therefore, if the pin 30 is used to make the power connection between two adjacent printed circuit boards (not shown), and the two circuit boards are slightly misaligned, the metal pin 30 can have the movement necessary to allow the metal pin 30 to mate with a complementary power receptacle connector (not shown) which is slightly misaligned with the pin.

The housing 20 and the bottom cover 40 are of a very simple design and can be easily and cheaply made using plastic insert molding techniques. The terminal plates 50 are also of a simple design, are easily and cheaply made, and can be more robust than contacts of the prior art. Assembly of the power connector 1 is straight-forward and easily accomplished. The power connector 1, therefore, should be more easily and cheaply produced than prior art connectors.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A power connector for mounting to a printed circuit board and for mating with a complementary connector, comprising:

a dielectric housing defining a cavity therein, the housing having a first opening at a bottom thereof and at least a second opening through one wall of the housing and communicating with the cavity, and at least one slot defined in an inner surface of the housing and communicating with the cavity and with the first opening;

a conductive, metallic pin extending through the second opening and into the cavity, the metallic pin being for mating with the complementary connector; and conductive terminal plates, each terminal plate comprising:

a body plate, made from a resilient metal material and having outside edges defining an outside perimeter of the body plate, said body plate being received through the first opening and into the cavity and being engagable at at least one of the outside edges with the at least one slot, said body plate further having a first aperture for receiving and electrically engaging with the metallic pin, said first aperture being defined through the body plate within an area defined by the outside perimeter, the body plate further having a plurality of second apertures defined therethrough, distinct from and not in communication with the first aperture, and also located within the area defined by the outside perimeter, said second apertures being arranged in a pattern around and in such proximity to the first aperture, that arms formed in said resilient metal material between said first aperture and said second apertures are resiliently displaceable away from the first aperture; and at least one contact pin integrally formed with the body plate and extending through the first opening when the body plate is assembled in the cavity, the contact pin being for electrically engaging with the printed circuit board;

further comprising a dielectric bottom cover attachable to the housing to cover the first opening, the bottom cover having at least a slit for accommodating passage of each contact pin through the bottom cover;

wherein the first aperture has at least one axis of symmetry and the pattern of second apertures is symmetrically arranged around the first aperture;

wherein the first aperture has six sides and is surrounded by three, symmetrically positioned second apertures, and three resilient arms are formed symmetrically around the first aperture;

wherein three sides of the first aperture are convex in shape and three are concave in shape, and the convex sides alternate with the concave sides;

wherein the second apertures are crescent-shaped;

wherein each contact pin has a needle eye opening defined therein for aiding retention of the terminal plate in a through hole of the printed circuit board;

wherein each terminal plate has two contact pins;

wherein the at least one slot is a corresponding pair of slots for each terminal plate, each pair being defined in the inner surface of the housing at each of two opposite sides of the cavity, and each terminal plate engages at opposite edges of the body plate with the corresponding pair of slots.

* * * * *